US010501248B2

(12) United States Patent
Ghiam

(10) Patent No.: US 10,501,248 B2
(45) Date of Patent: Dec. 10, 2019

(54) BLISTER PACKAGE AND METHOD OF MANUFACTURE

(71) Applicant: Tekni-Plex, Inc., Wayne, PA (US)

(72) Inventor: Farid F. Ghiam, Perrysburg, OH (US)

(73) Assignee: Tekni-Plex, Inc., Wayne, PA (US)

( * ) Notice: Subject to any disclaimer, the term of this patent is extended or adjusted under 35 U.S.C. 154(b) by 0 days.

(21) Appl. No.: 15/341,497

(22) Filed: Nov. 2, 2016

(65) Prior Publication Data

US 2018/0118437 A1 May 3, 2018

(51) Int. Cl.

| | |
|---|---|
| ***B65D 75/58*** | (2006.01) |
| ***A61J 1/03*** | (2006.01) |
| ***B65B 3/02*** | (2006.01) |
| ***B65B 7/16*** | (2006.01) |
| ***B65B 51/10*** | (2006.01) |

(Continued)

(52) U.S. Cl.

CPC ..... *B65D 75/5816* (2013.01); *A61J 1/035* (2013.01); *B65B 3/022* (2013.01); *B65B 7/16* (2013.01); *B65B 51/10* (2013.01); *B65B 61/182* (2013.01); *B65D 65/38* (2013.01); *B65D 75/327* (2013.01); *B65D 75/527* (2013.01); *B65D 75/5855* (2013.01)

(58) Field of Classification Search

CPC .. A61J 1/035; A61J 1/03; B65D 65/38; B65D 75/327; B65D 75/527; B65D 75/5816; B65D 75/5855; B65D 83/04; B65D 75/32; B65D 75/36; B65D 75/58; B65D 75/52

USPC ..... 206/531, 532, 538, 539; 249/61, 127, 249/160–169

See application file for complete search history.

(56) References Cited

U.S. PATENT DOCUMENTS 4,899,976 A * 2/1990 Cederroth ..... F25C 1/243 206/532

4,988,004 A 1/1991 Intini (Continued)

FOREIGN PATENT DOCUMENTS

DE 9313193 U1 10/1993
FR 85821 E 10/1965

(Continued)

OTHER PUBLICATIONS

Int'l. Search Report and Written Opinion dated Jan. 28, 2018 in corresponding Int'l. Appln. No. PCT/US2017/058993.

*Primary Examiner* — Bryon P Gehman
(74) *Attorney, Agent, or Firm* — Polsinelli PC

(57) ABSTRACT

Blister package having a novel pull tab construction that enables opening of each individual product cavity of the blister package. The pull tab is formed by breaking off a portion of a base substrate along a notched line that includes a series elongated severed portions extending completely through the thickness of the base substrate, separated by the unsevered (connected) portions. The notched line can be formed in the same mold that is used to form the recessed product cavity of the base substrate, thereby reducing the number of manufacturing steps and equipment, resulting in a significant cost savings during manufacture. The new notch line configuration eliminates the problems of the prior art with score depth achievement and consistency, while providing a reliable breakable line, and enable less brittle (non-PVC) polymers to be used. It also eliminates the problem with knife wear that prevented score depth achievement and consistency with non-PVC materials.

15 Claims, 9 Drawing Sheets

(51) Int. Cl.

| | |
|---|---|
| ***B65B 61/18*** | (2006.01) |
| ***B65D 65/38*** | (2006.01) |
| ***B65D 75/32*** | (2006.01) |
| ***B65D 75/52*** | (2006.01) |

(56) References Cited

U.S. PATENT DOCUMENTS

| | | | | | |
|---|---|---|---|---|---|
| 5,046,618 | A * | 9/1991 | Wood | B65D 75/327 206/532 |
| 5,172,812 | A | 12/1992 | Wharton et al. | |
| 5,325,968 | A | 7/1994 | Sowden | |
| 5,393,032 | A | 2/1995 | Cederroth | |
| 5,878,888 | A | 3/1999 | Faughey et al. | |
| 6,006,913 | A | 12/1999 | Ludemann et al. | |
| 6,155,423 | A * | 12/2000 | Katzner | B65D 75/327 206/531 |
| 7,093,816 | B2 * | 8/2006 | Lacan | F25C 1/243 249/127 |
| 7,121,410 | B2 * | 10/2006 | Rohrmus | B65D 75/327 206/531 |
| 7,188,728 | B2 * | 3/2007 | Williams-Hartman | B65D 75/36 206/531 |
| 9,138,378 | B2 * | 9/2015 | McArthur | B65D 75/327 |
| 9,682,012 | B2 * | 6/2017 | Pattison | A61J 1/035 |
| 2007/0289893 | A1 * | 12/2007 | Williams, Jr. | B65D 75/327 206/531 |
| 2016/0257438 | A1 | 9/2016 | Van Landeghem et al. | |

FOREIGN PATENT DOCUMENTS

| | | | |
|---|---|---|---|
| JP | S5746702 | A | 3/1982 |
| WO | 9936329 | A1 | 7/1999 |

* cited by examiner

BLISTER PACKAGE AND METHOD OF MANUFACTURE

FIELD OF THE INVENTION

The present invention relates to a blister package and method of manufacture, the package including a novel pull tab configuration for opening an individual product compartment of the package.

BACKGROUND OF THE INVENTION

Blister packaging is known for receiving a product, e.g., in tablet, powder, or other form, wherein each of the individual recesses or compartments of the base substrate can be provided with a product and the packaging can then be sealed with a cover layer, e.g., in the form of a lidding film. The lidding film must seal to the base substrate on sealing surfaces provided between the recesses, whereby the lidding film encloses the product filled recesses of the base substrate. As a result, the packaged product is sealed tight against the exterior environment and each individual product in the various compartments is separated from one another.

The method and degree of difficulty encountered in opening such blister packaging is often tailored to the intended user, wherein packaging for seniors may be made relatively user friendly (easier to open) while other packaging may be designed to be more difficult to open (e.g., child resistant). Still other packaging is designed for tamper resistance. In some packaging the cover layer can be removed by peeling, while in others the cover layer is broken by pushing the product through the cover layer to remove the product from the compartment. It will be understood that the base substrate and cover layer may include multiple layers and multiple materials that serve different functions.

In addition to designing for an intended use (e.g., ease of opening, size and composition of product, designated shelf-life), the packaging designer must account for the number and complexity of the steps and the expense of the equipment required to form the single or multilayer components, to assemble them into a package, and to fill the individual compartments with the product. Also relevant is the recyclability of the various components.

One type of blister packaging, referred to as "bend and peel", is formed from a polyvinyl chloride (PVC) base substrate, and attached cover layer, wherein an edge portion of the package can be bent back by the user along a reduced thickness score line, breaking the brittle PVC base substrate along the score line to form a tab from the broken off portion of base substrate and attached cover layer, thus enabling the user to grab the tab and peel off the cover from an area adjacent a product compartment in the base substrate to release the product from the package.

There are a number of problems with this bend and peel product. First it only works reliably with a brittle material like PVC; more specifically, the score depth can vary widely (e.g., in a broad range of 50-80%), and because PVC is so brittle, it will break reliably in use. However, many companies prefer not to use PVC for packaging, because the consumer recycling stream is not as well established as it is for other materials. Attempts to use other materials that are substantially less brittle than PVC, such as polyesters, have failed because they require a much tighter range of score depth to ensure that every user can bend and reliably break the package along the score line. For example, using a polyester based film, such as polyethylene terephthalate (PET) film at 12 mil thickness, would require a score depth of at least 10 mils. This requires a very sharp knife to guarantee the necessary score depth. Deeper cuts such as these are difficult to accomplish without inadvertently cutting through the entire thickness. Another problem is that every film varies in thickness, so for example a 10 mil film may vary between 9.5 to 10.5 mils or even wider depending on the film production quality. This makes it impossible to guarantee the required thickness depth in any practical manufacturing operation. It further requires a very sharp knife edge for every cut, which is prohibitively expensive as the manufacturer must continually replace or re-sharpen the blade.

Thus, there is an ongoing need for materials and processes for making blister packaging that overcome the various material, process and cost limitations of the prior art.

SUMMARY OF THE INVENTION

The present invention is directed to providing a blister package having a novel pull tab construction that enables opening of an individual product compartment of the blister package. The pull tab is formed by breaking off a portion of a base substrate along a notched line. The notched line includes a series of alternating severed and unsevered line portions, the elongated severed portions extending completely through the thickness of the base substrate, while the elongated unsevered portions each comprise a connected portion of the base substrate material, between the severed (cut through) portions. One particular advantage is that the notched line can be formed in the same mold that is used to form the recessed product cavity of the base substrate. This reduces the number of manufacturing steps and required equipment, resulting in a significant cost savings during manufacture. Another benefit is that providing alternating severed and unsevered line portions in the notched line enables the use of a wider variety of base substrate materials. For example, rather than requiring the use of a base substrate of PVC, which is brittle and therefore breaks easily, in accordance with the present invention less brittle polymers can be used. The new break line configuration eliminates the problems of the prior art with score depth achievement and consistency, while providing a reliable breakable line. It also eliminates the problem with knife wear that prevented score depth achievement and consistency with non-PVC materials.

Other advantages of the present invention will be more particularly described below in the detailed description.

A blister package and method of manufacture are provided, the package including a novel pull tab configuration for opening an individual product compartment of the package. According to one embodiment the blister package includes:

- a thermoformed plastic base substrate having a thickness, the base substrate having at least one thermoformed recessed product cavity to retain product therein and an associated sealing surface area surrounding the product cavity,
- a peelable cover layer removably attached to the base substrate comprising a first portion covering the product cavity and a second portion overlapping and sealed to the surrounding sealing surface area,
- the base substrate having a notched line extending across the sealing surface area between two points on a perimeter of the sealing surface area and spaced from the product cavity, the notched line including alternating severed and unsevered line portions, the severed line portions extending completely through the thickness of the base substrate while the unsevered line portions comprise connected portions;

wherein a portion of the base substrate is configured to be bent and broken off by a user at the notched line to form a pull tab that includes the broken off portion of the base substrate and the cover layer sealed thereto, enabling a user grasping the pull tab to peel back and separate the cover layer from the sealing surface area surrounding the product cavity to enable release of a product from the product cavity.

In one embodiment, the blister package includes a plurality of separable sections, each section comprising a recessed product cavity with its associated sealing surface area, notched line and cover layer.

The blister package may further include a plurality of section lines, the section lines extending between each section and defining at least a portion of a perimeter of each section, the section lines enabling each section to be separated from the other sections and wherein the notched line of each section extends between two points on the perimeter of the section.

In one embodiment, the at least one recessed cavity is configured to receive a medical, health, food, cosmetic or industrial product.

In one embodiment, the at least one recessed product cavity is shaped in the form of a tablet or capsule.

In one embodiment, the notched line is a straight line or a curved line, or includes a combination of straight and curved line portions.

In one embodiment, the notched line extends between two edges of the sealing area perimeter to form a corner broken off portion.

In one embodiment, the notched line extends between two points on one edge of the sealing area perimeter to form a broken off portion.

In one embodiment, one or more of the thermoformed base substrate, and the cover layer, are of multilayer construction.

In one embodiment, the thermoformed plastic base substrate comprises one or more of polyester, polyacrylate, polycarbonate, polyolefin, polystyrene, and polyvinyl chloride (PVC), including copolymers and blends thereof.

In one embodiment, the thermoformed plastic base substrate comprises one or more of polyethylene terephthalate (PET), high density polyethylene (HDPE), polymethyl methacrylate (PMMA), polyethylene methacrylate, and glycol modified PET (PET G), including copolymers and blends thereof.

In one embodiment, the cover layer includes a sealant for removable attachment to the sealing surface area of the base substrate.

In one embodiment, the sealant comprises a heat sealable material.

In one embodiment, the thickness of the base substrate is in a range of 6 to 25 mils (thousandths of an inch).

In one embodiment, the notched line comprises in a range of 40 to 90% severed portions as a ratio of total length of the severed portions to total length of the notched line.

In one embodiment, the notched line comprises in a range of 60 to 90% severed portions as a ratio of total length of the severed portions to total length of the notched line.

In one embodiment, the notched line comprises in a range of 70 to 85% severed portions as a ratio of total length of the severed portions to total length of the notched line.

In accordance with another embodiment of the invention, a method of forming a blister package is provided, the blister package including a thermoformed plastic base substrate and a peelable cover layer removably attachable to the base substrate, the method comprising:

thermoforming in a mold a base substrate of the blister package from a sheet of thermoformable material, the mold including a recessed molding surface to from a recessed product cavity and a molding surface surrounding the recessed molding surface to form an associated surrounding sealing surface area of the base substrate, forming in the mold, either sequentially or simultaneously with the forming of the recessed product cavity, a notched line in the base substrate extending across the sealing surface area and spaced from the recessed product cavity, the notched line including alternating severed and unsevered line portions, the severed line portions extending completely through a thickness of the base substrate while the unsevered line portions comprise connected portions, filling the recessed product cavity with a product, and attaching a peelable cover layer to the base substrate, the cover layer extending over the filled product cavity and being removably attachable to the surrounding sealing surface area.

In one embodiment, the thermoforming step includes forming a plurality of sections of the base substrate in the mold, each section comprising a recessed product cavity and associated surrounding sealing surface area and notched line, and wherein the filling and sealing steps include filling each recessed product cavity with a product and attaching the cover layer to the plurality of sections of the base substrate.

In one embodiment, the method includes:

forming a plurality of section lines defining at least a portion of a perimeter of each section, wherein the notched line extends between two points on the perimeter of the section.

In one embodiment, the method includes:

cutting through a thickness direction of the cover layer and base substrate to form a perimeter of the sealing surface area, wherein the notched line extends between two points on the perimeter of the sealing surface area.

BRIEF DESCRIPTION OF THE DRAWINGS

The following figures illustrate various embodiments of the invention in more detail.

DETAILED DESCRIPTION OF THE INVENTION

Figure 1:
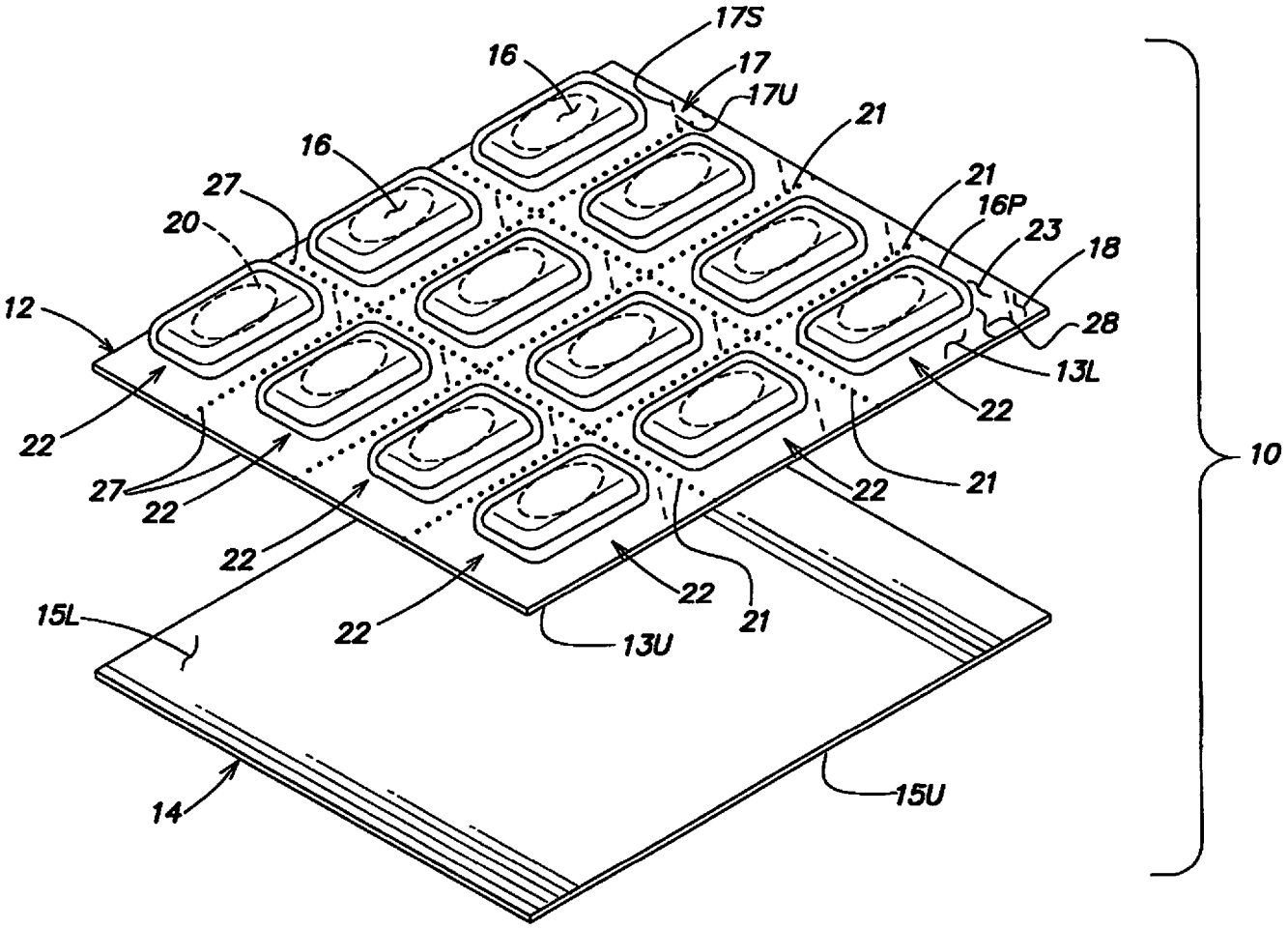
FIG. 1 is an exploded perspective view of the component parts of a multi-cavity blister package according to one embodiment of the invention, which includes a base substrate and a detachable (peelable) cover layer.

FIG. 1 illustrates one embodiment of a blister package according to the present invention.

FIG. 1 is an exploded view of the component parts of a multi-cavity blister package 10, including a base substrate 12 and a cover layer 14. The base substrate includes a plurality of recessed product cavities 16, here aligned in a rectangular array, of the rectangular base substrate 12. A product 20 (e.g., a tablet) is shown disposed in each of the recessed cavities 16. In this embodiment, the base substrate 12 is a substantially transparent or translucent substrate that allows viewing of the product in the cavity 16; in another embodiment, base substrate 12 may be opaque. As described below, the base substrate 12 has an upper surface 13U that will be removably attached to a lower layer surface 15L of a cover layer 14, so as to enclose the product 20 in the recessed cavity 16 (see FIG. 2A).

Figure 2A:
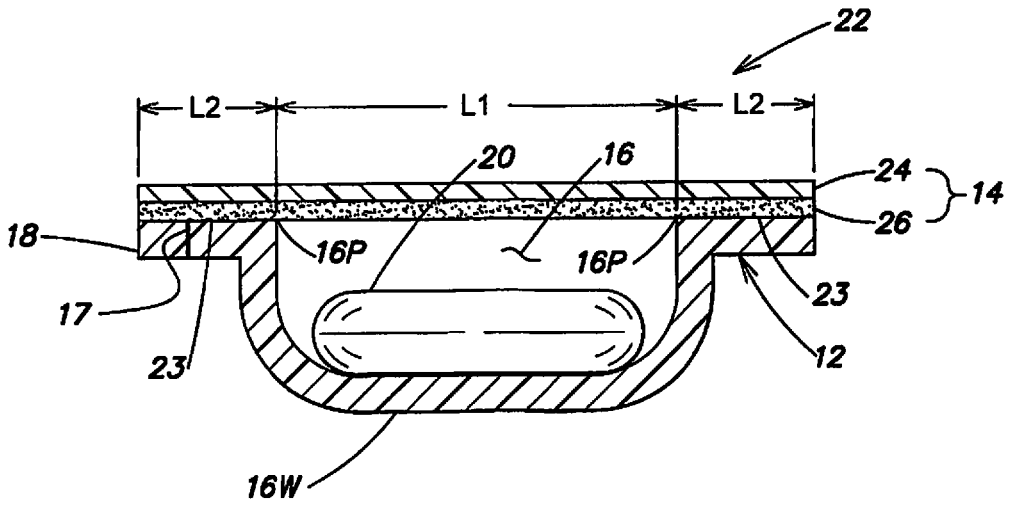
FIG. 2A is a cross sectional view of one section of the blister package of FIG. 1.

As shown in FIG. 1, the base substrate 12 has a plurality of perforated section lines 21 that separate the base substrate into a plurality of sections 22, each section having at least one cavity 16, formed by a recessed cavity wall 16W (as shown in FIG. 2A), and a sealing surface area 23 surrounding the entire perimeter 16P of the cavity 16. In this embodiment, the rectangular array of cavities 16, includes 12 cavities arranged in a four by three array, and there is a three by two grid of transverse section lines 21 that divide the blister package into a rectangular array of twelve sections 22. As described further below, each section 22 can be separated from the remaining sections of the blister package by tearing off one (or more) section(s) along the adjacent section lines 21, leaving the remaining substrate sections still connected.

In accordance with the invention, each section 22 also includes a notched line 17 which extends across a portion of the sealing area 23, is spaced apart from the cavity 16, and extends between two points on the perimeter 27 of the section 22. The perimeter of the section is defined by: one or more of the outer edges of the base substrate 12 and the section lines 21; or by the surrounding section lines 21 (if the section does not border an outer edge of the base substrate 12). The notched line 17 separates a corner portion 18 (FIG. 1) or other edge portion 18" (FIG. 9) of the section 22 from the remaining portion 28 of the section.

Figure 9:
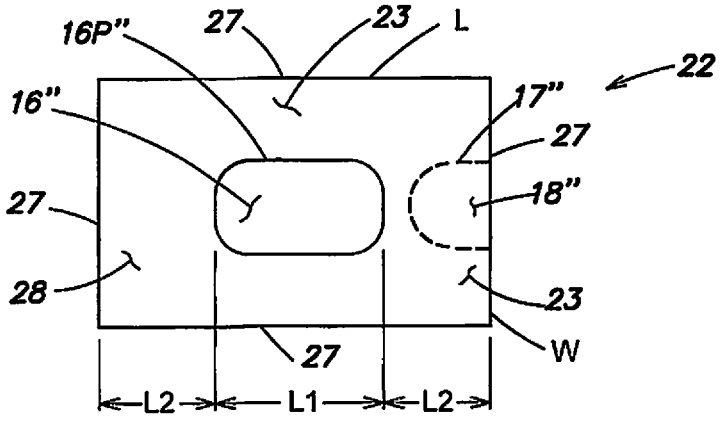
FIG. 9 is a top plan view similar to FIG. 5 but of an alternative embodiment having a U-shaped tab portion.

The notched line includes alternating severed portions 17S and unsevered portions 17U, the severed line portions 17S extending completely through the thickness of the base substrate 12 while the unsevered line 17U portions comprise connected line portions (of the base substrate 12). This is shown more clearly in FIGS. 2A-3, showing a severed portion 17S of line 17 in cross section extending completely through the base substrate 12. As used herein the notched line may be a straight line 17 (e.g. as shown in FIGS. 1-2A), comprising a linear series of severed and unsevered portions, or it may be a curved line 17" (e.g. as shown in FIG. 9) comprising a curved series of severed and unsevered portions, or some combination of linear and curved portions.

Figure 2B:
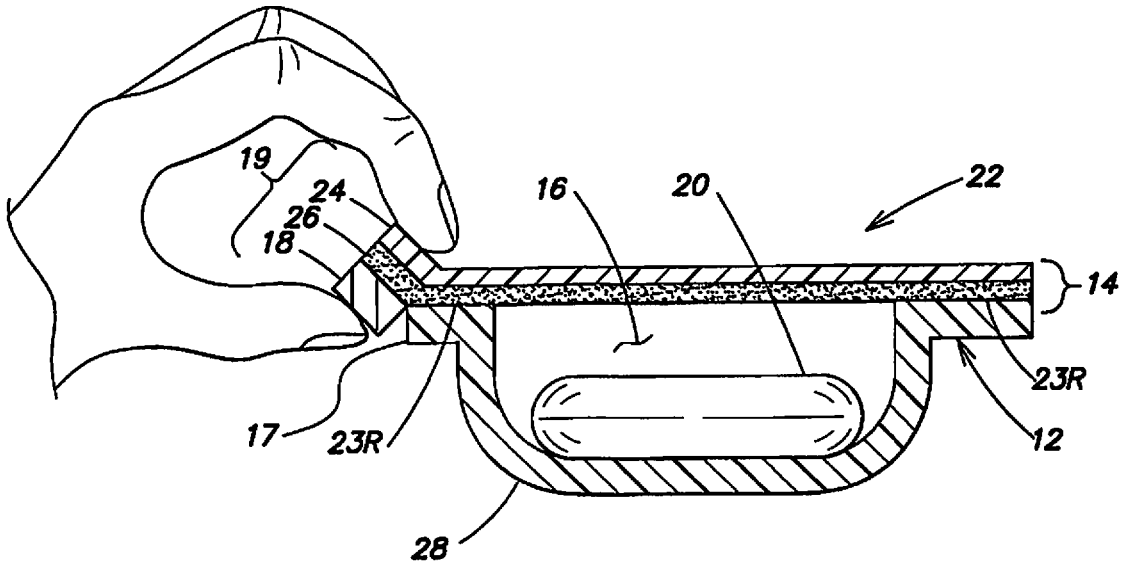
FIG. 2B is the same cross sectional view of FIG. 2A showing a user breaking off the corner of the base substrate and cover layer to form a pull tab.
Figure 2C:
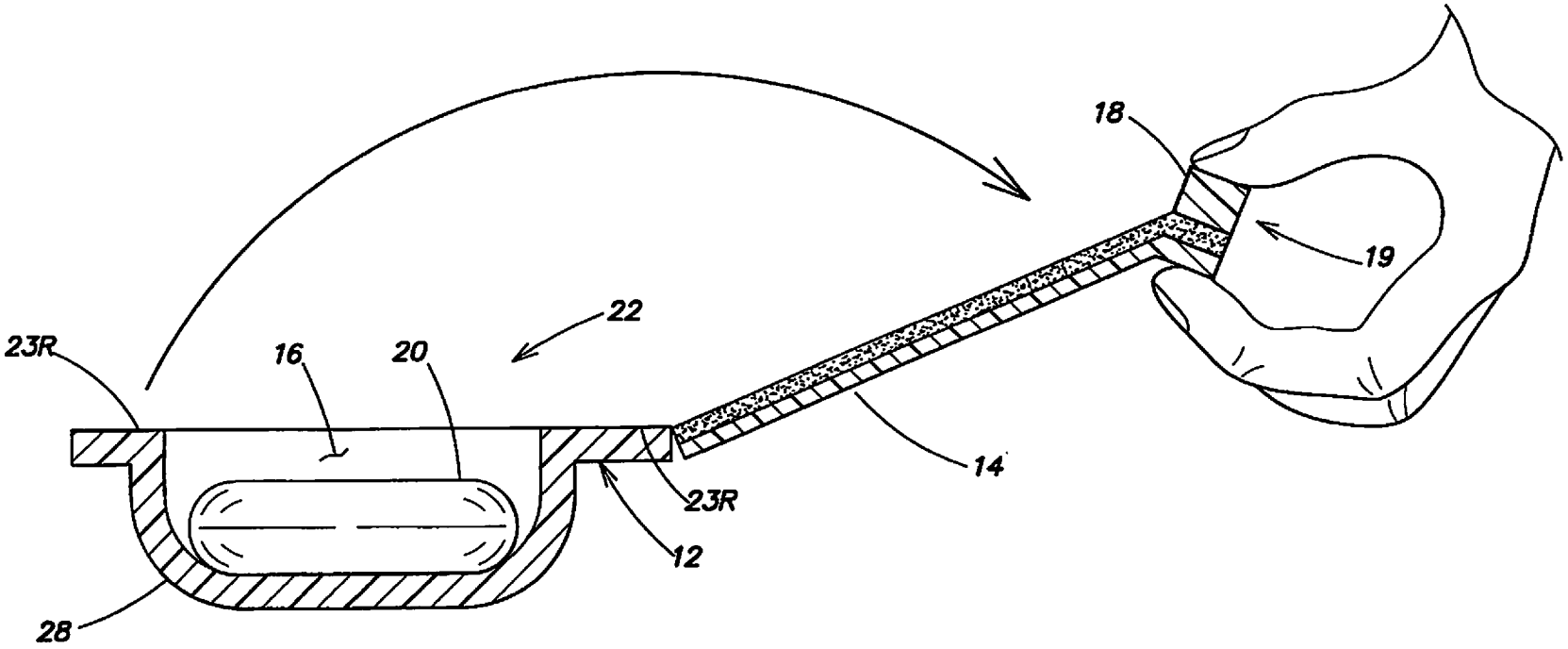
FIG. 2C is the same cross sectional view of FIGS. 2A and 2B showing a user having peeled the cover layer off the base substrate, enabling removal of the product from the recessed cavity of the base substrate.

In use (see FIG. 2B), after an individual section 22 is removed from the remainder of the blister package, a portion 18 of the sealing area of the removed section 22 (defined by the notched line 17 and section perimeter 27) can be bent and broken off from the remaining portion 23R of the sealing area 23, wherein the broken off portion 18 and attached cover layer 14 forms a pull tab 19 (shown in FIG. 2B) that enables a user to grasp the pull tab and peel off the cover layer 14 from the remaining sealing area 23R around the cavity 16, exposing the cavity, and thereby enabling release of the product from the cavity (as shown in FIGS. 2A-2C).

FIG. 2B shows a user bending back the corner 18 of the base substrate and attached cover layer at the notched line 17 to form pull tab 19. After separating the corner portion 18 of the base substrate from the remaining portion of the base substrate, the user can grasp the pull tab 19 (broken off portion 18 with attached cover layer 14) in order to peelably remove the cover layer 14 from the sealing area 23 around the cavity, and thus release the product 20 from the cavity 16 (as shown in FIG. 2C).

FIG. 2A shows in greater detail one section 22 of the blister package 10. Here, the cover layer 14 has been removably secured to the base substrate 12, with a product 20 enclosed in the sealed cavity 16. The section 22 has a lengthwise dimension, which includes a recessed central product cavity are of length L1, and at each of the opposing ends of the cavity area (defined by cavity perimeter 16P), a sealing area 23 of length L2. The cover layer is disposed over the cavity area 16 and is removably attached to the sealing area 23 that surrounds the cavity area 16.

The cover layer 14 includes an outer layer 24 and an inner sealant layer 26, wherein the latter is removably adhered to the upper surface 13U of the sealing areas 23 of the base substrate 12. In this embodiment, the sealant layer is provided in the cavity area 16, although a sealant function is not required in this area; thus in other embodiments the sealant may not be present in this area. The cover layer 14 can be removed by peeling the cover layer off of the sealing area 23 surrounding the cavity 16, as described further below.

Figure 3A:
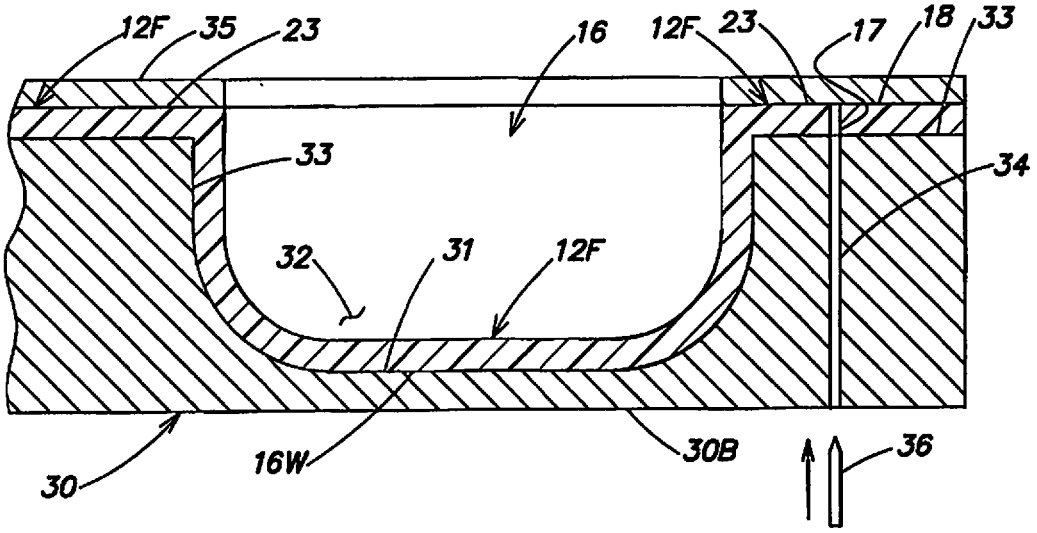
FIG. 3A is a cross sectional view of a mold according to one method embodiment of the invention, for forming in the mold a recessed cavity and an associated notched line in the surrounding sealing surface area for one section of the blister package of FIG. 1, wherein a notched cutting blade for forming the notched line approaches from a bottom surface of the base substrate (adjacent the mold surface).
Figure 3B:
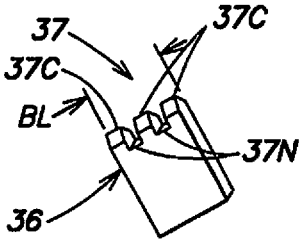
FIG. 3B is a perspective view of the notched cutting blade of FIGS. 3A and 4.
Figure 4:
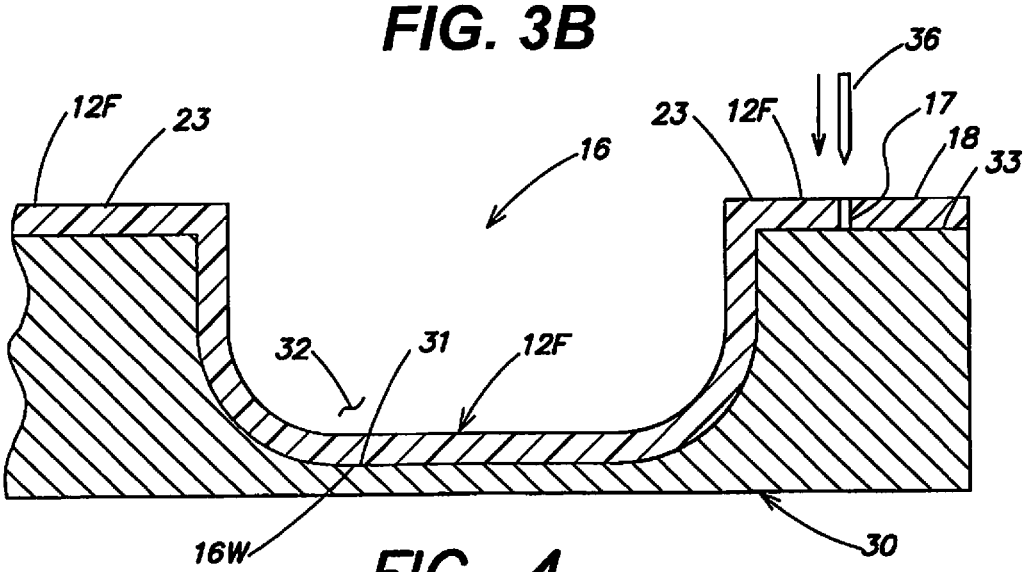
FIG. 4 is a cross sectional view showing another method embodiment, similar to FIG. 3A, but wherein the notched blade approaches from a top surface of the base substrate.

FIGS. 3A-4 illustrate two methods of thermoforming a base film sheet to form a base substrate having a recessed product cavity and an associated sealing area in a mold. As described below, a notched line can also be formed in the sealing area simultaneously or sequentially while the recessed cavity is being thermoformed in the mold.

FIG. 3A is a cross section of a mold 30 having an upper surface 31 for forming the base substrate 12 from a base film sheet 12F of thermoformable polymer material, in the mold. A recess or cavity 32 in the upper surface 31 of the mold is defined by a recessed mold wall 33 shaped to form the recessed product cavity or compartment 16 in the base substrate. In various embodiments the shape of the recessed mold wall 33 may conform to the shape of a tablet, capsule, liquid, gel, or other three dimensional product. The base film sheet 12F is applied over the mold cavity 32 and surrounding upper mold surface 31 to form the product cavity 16 and surrounding sealing area 23 respectively of the base substrate 12. The same mold 30 can be used for forming the notched line 17, by a notched cutting blade 36, in the sealing area 23 surrounding the associated product compartment 16.

FIG. 3B is a perspective view of the notched blade 36, having a notched cutting edge 37 defined by alternating elongated cutting portions 37C and elongated notched portions 37N, aligned along a length direction BL of the blade. The blade cutting edge 37 is configured to form the notched line 17, having alternating severed line portions 17S (formed by the cutting blade portions 37C) that extend completely through the thickness of the base substrate 12, and unsevered line portions 17U (formed by notched blade portions 37N), that maintain at least some uncut (integral) thickness of the substrate 12 intact. This configuration of notched line 17 enables the base substrate to be made of polymer materials that are relatively less brittle than polyvinylchloride. By providing the alternating severed portions and unsevered portions, the base substrate can be bent back (by a user) along the ridged line 17, and then easily and reliably completely severed (by the user) from the remaining portion of the base substrate as shown in FIG. 2B.

In the embodiment of FIG. 3A, the notched blade 36 is inserted through a slit 34 in the bottom 30B of the mold, enabling the notched cutting edge 37 to engage and cut through space apart linear portions of the sealing area in the thickness of the base substrate, while still in the mold. In one embodiment, a top mold plate 35 holds the sealing area in position during the cutting and acts as a stop; preferably, movement of the blade is controlled (e.g., by computer program) to reduce wear on the cutting edges of the blade. Alternatively, the base film can be held to the mold surface by suction, without requiring a top plate.

FIG. 4 shows an alternative embodiment of a thermoforming mold for forming the blister cavity 16, and associated notched line 17. However, in FIG. 4 the notched blade 36 is applied from above the base film. The blade cuts down through the thickness of the film, wherein the upper mold surface 31 may act as a stop. Alternatively, a slot (not shown) may be formed in a top plate of the mold, for guiding the notched cutting blade into position in the mold.

Figure 5:
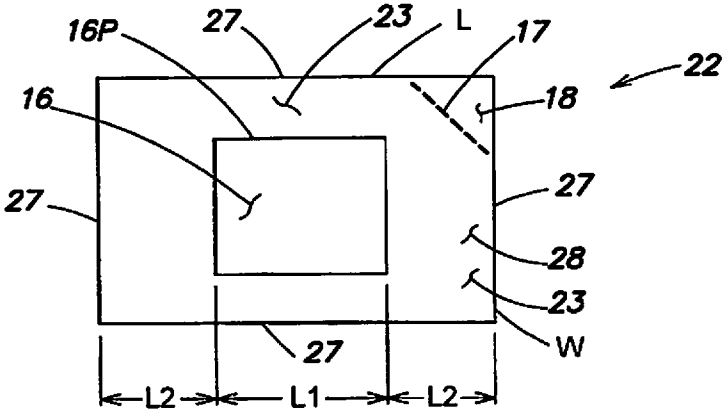
FIG. 5 is a top plan view of one section of the blister package after the forming steps of FIGS. 3A or 4.

FIG. 5 is a top plan view of one resulting scored blister section 22, the section 22 including a recessed product cavity 16 in a central portion of the section, sealing area 23 surrounding the perimeter 16P of the product cavity 16, and a notched line 17 extending across the sealing area, spaced from the cavity 16, and separating the section 22 into a removable section 18 and a remaining section 28 of the base substrate. The notched line 17 extends between two points on the perimeter 27 of the section 22; here the two points are on adjacent length L and width W perimeter edges that meet at a corner of the rectangular section 22, thereby defining a removable corner portion 18 of the section 22. The remaining non-corner portion 28 (on the other side of the notched line 17 from corner portion 18) includes the cavity 16 and surrounding portion of sealing surface area 23 with attached cover layer 14. Alternative configurations of notched line 17 can also be utilized; for example, as shown in FIG. 9, a U-shaped notched line 17" can be provided that extends from two spaced apart points on one edge of the section 22 (the width edge W) to form a U-shaped tab section 18". Other shapes for the notched line 17, and resulting tab 18, are suitable as well. In other embodiments, the section 22 is not rectangular; it may be square shaped, wherein the section length L equals the section width W. Alternatively the section may be triangular, or any multi-sided shape, including straight or curved side edges.

Figure 6A:
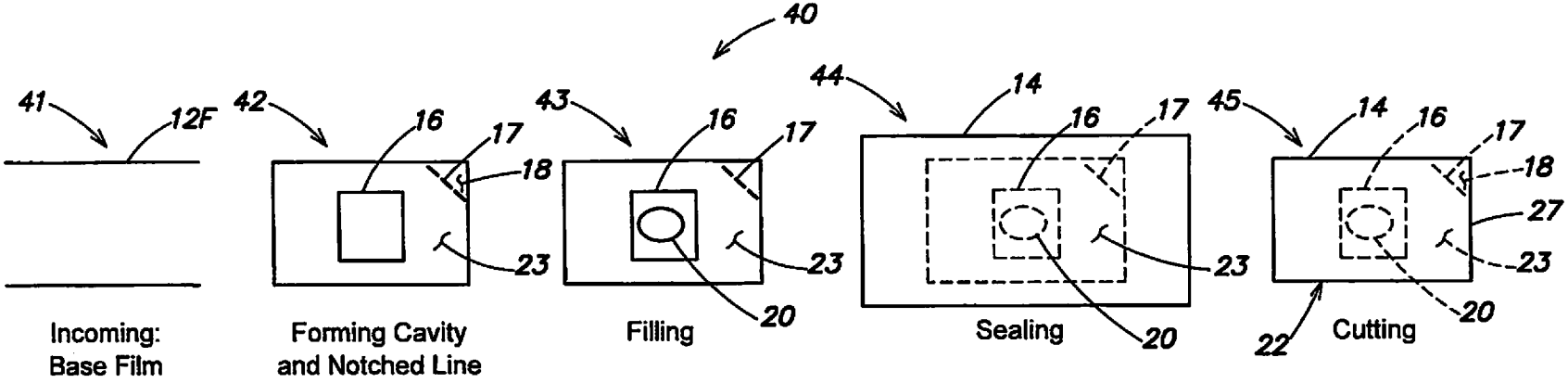
FIG. 6A is a schematic top plan view of one embodiment of an in-line method of forming, filling, sealing, and cutting to form one section of a blister package.

FIG. 6A is a schematic illustration of one method embodiment 40 of the invention, including steps 41-45. In a first step 41, an incoming sheet of base film 12F (to form the base substrate 12), is provided. At step 42, the base film is formed into a base substrate by forming the recessed cavity 16, with a surrounding sealing area 23, and a notched line 17 is formed across one corner of the sealing area to form the corner portion 18. In step 43, cavity 16 is filled with the product 20. In step 44, a cover layer 14 is affixed to the sealing area 23 of the base substrate. In step 45, a perimeter 27 of a package section 22 is defined by cutting through the thickness of the cover layer 14 and base substrate 12, to form a single cavity blister package.

Figure 6B:
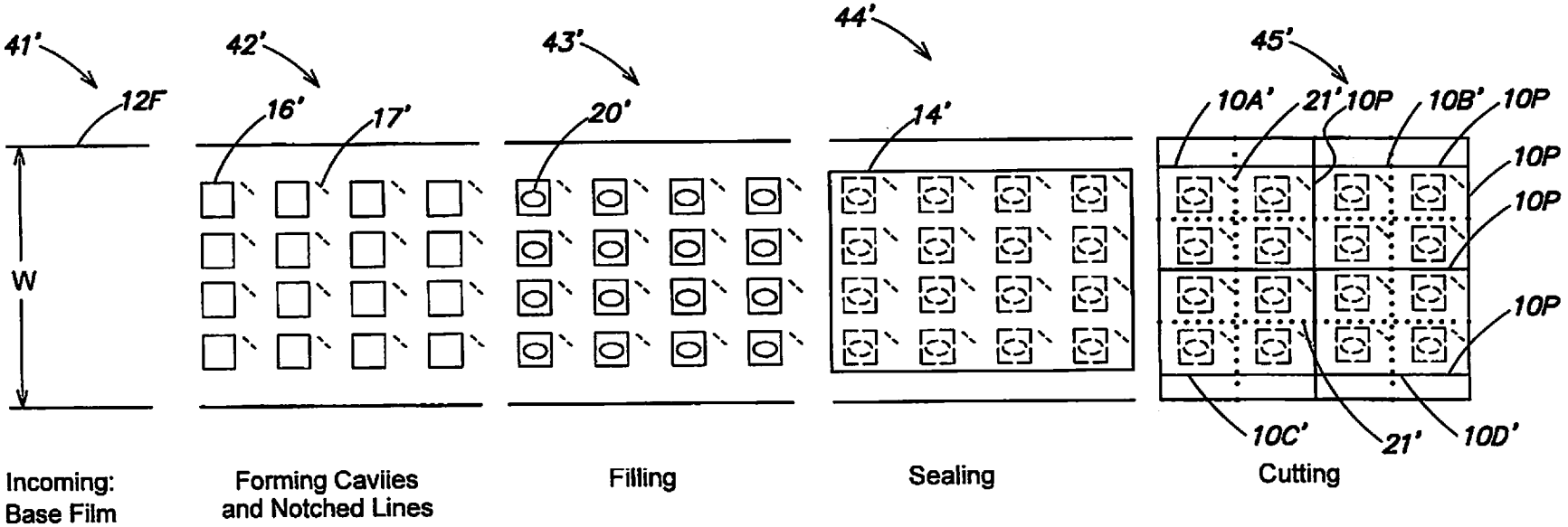
FIG. 6B is a schematic top plan view similar to FIG. 6A but showing an alternative in-line method for making a multi-cavity blister package.

FIG. 6B shows an alternative in-line manufacturing process of sequential steps 41' to 45', similar to FIG. 6A, but showing formation of multiple cavities 16' across the width W of the incoming base film 12F, and forming a plurality of multi-cavity packages 10A', 10B' 10C' and 10D' at the cutting station 45'. The section lines 21' are also formed at the cutting station 45'. A plurality of recessed product cavities 16' (in grid formation) and associated notched lines 17' are formed in step 42'.

Figure 7:
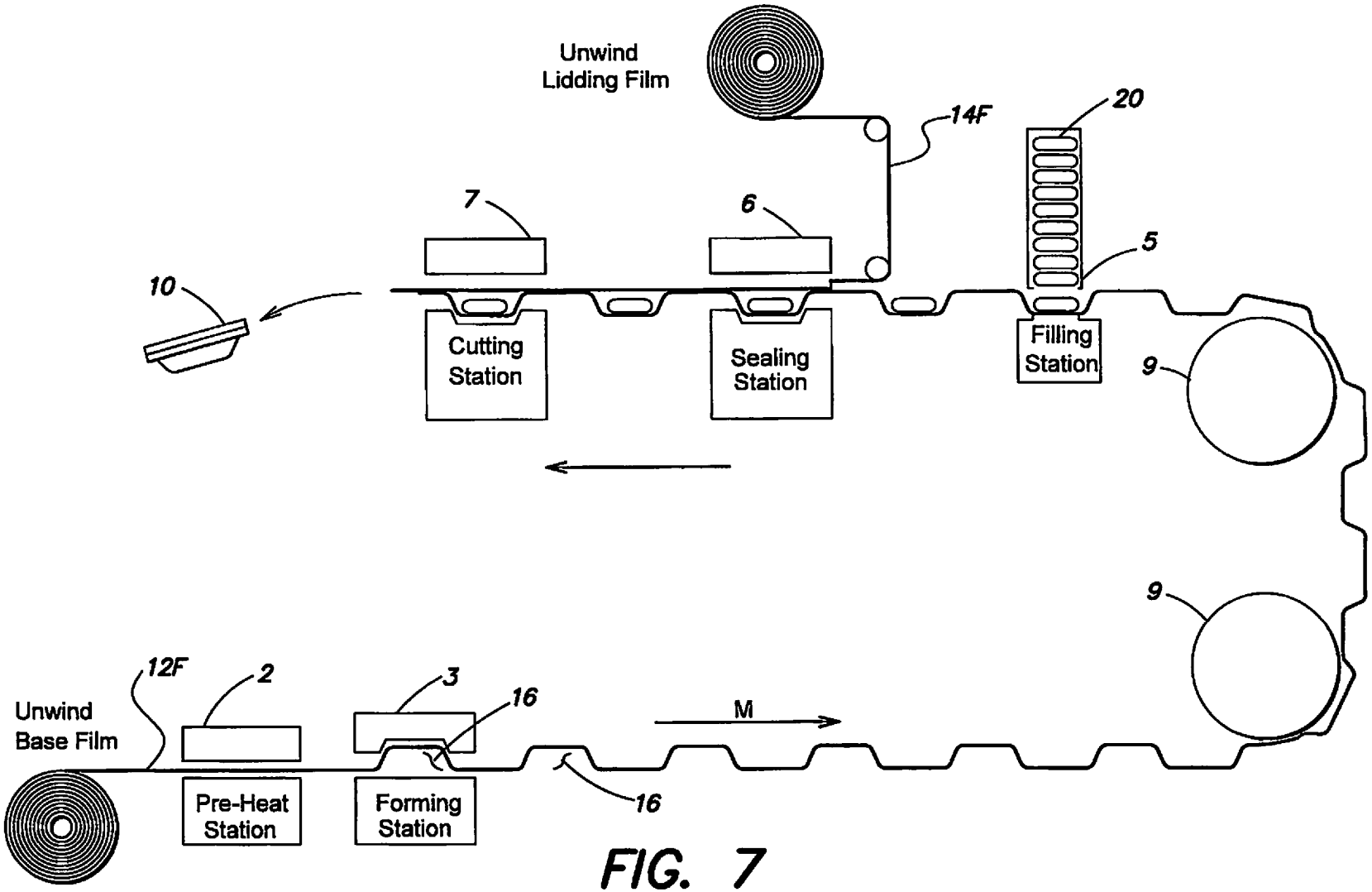
FIG. 7 is a schematic view of one embodiment of an assembly apparatus and process for forming a single or multi-cavity blister package, such as that shown in FIG. 1.

FIG. 7 shows one embodiment of an in-line forming and assembly apparatus for making a series of blister packages, either as single or multi-cavity packages. Starting at the lower left hand corner, a base film 12F is unwound from a roll of such film. The film 12F is fed to a preheat station 2 where the film is heated for a subsequent thermoforming step. At forming station 3 one or more recessed cavities 16, and an associated notched line 17 for each cavity, is formed in the base film (see FIGS. 1-6B showing recessed cavities 16 and associated notched lines 17). The formed base film, now including a series of recessed product cavities 16 and associated notched lines 17, is then fed 9 (e.g., by rollers 9) to a filling station 5 where a product 20 is added to each of the recessed product cavities 16. The filled base film is then fed to a sealing station 6; a lidding film 14F, unwound from a roll of such lidding film, is also fed to the sealing station 6. The lidding film is sealed to the sealing surface area 23 of the base film (around each filled cavity) at station 6 to form a composite of the lidding film and filled base film. The composite is then fed to the cutting station 7 where individual blister packages 10 may be cut, each blister package having a single cavity and associated notched line, or a plurality of cavities and associated notched lines. Section lines 21 (between each of the cavities 16) may also be formed at cutting station 7. The blister packages 10 are discharged from the assembly line.

The described embodiments provide a number of benefits. By forming the notched lines 17 effectively in-line (at molding station 42), as opposed to starting with a base film that includes notched lines 17, there is no need to closely register (align) the base film 12F with the mold cavities 32. Similarly by forming the perforated section lines 21 at the cutting station 45, as opposed to providing a base film that includes perforated section lines, again the need to closely register (align) the base film with the molding cavities and with the cutting stations is avoided.

Figure 8:
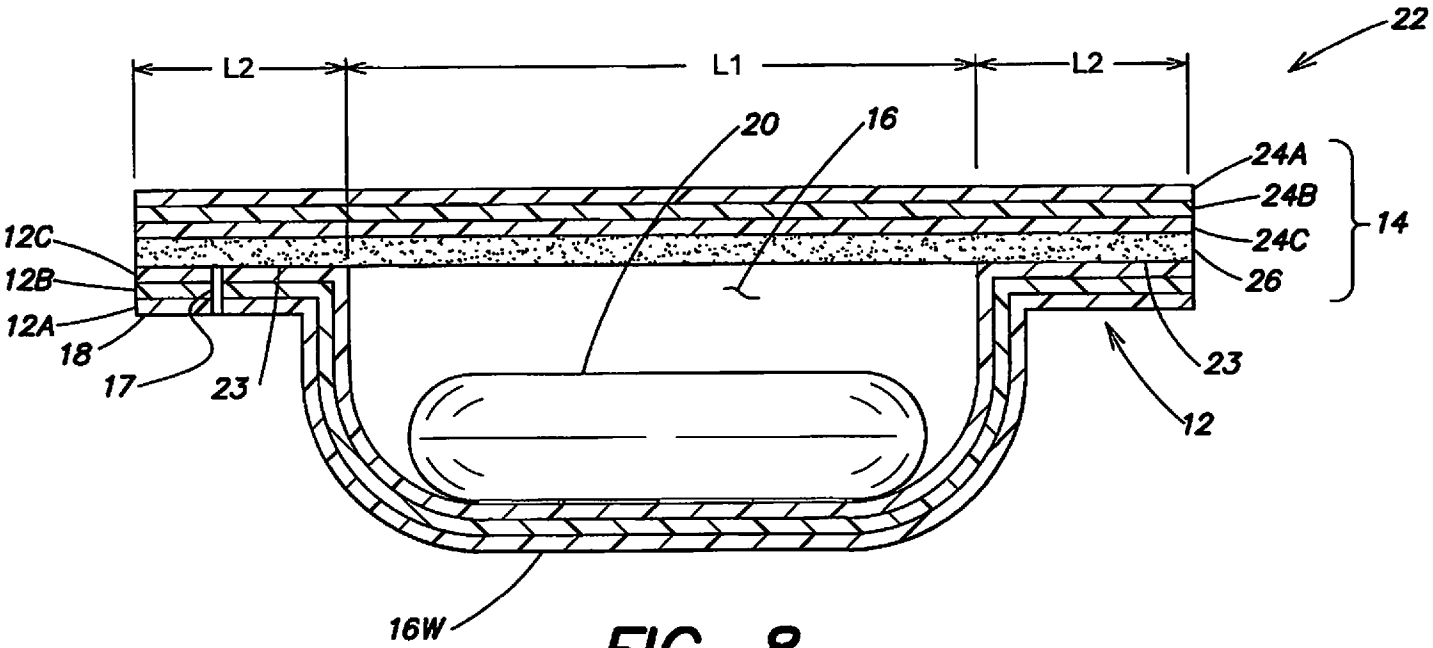
FIG. 8 is a cross sectional view of another blister package embodiment wherein the cover layer and base substrate are each of multi-layer construction.

In another embodiment, shown in FIG. 8, the outer layer 24 (of the cover layer 14) may include multiple layers, such as 24A, 24B and 24C; the multiple layers may be of the same or different materials and provide one or more of structural strength, gas barrier, moisture barrier, printing area, etc. Similarly, the base substrate 12 may include multiple layers, such as 12A, 12B and 12C; the multiple layers may be of the same or different materials and provide one or more of structural strength, gas barrier, moisture barrier, printing area, etc.

The materials, dimension and configurations of the various components can be varied according to the intended use. The following are examples of suitable materials and constructions.

The base film 12F that forms the base substrate 12 may of monolayer or multi-layer construction, formed by extrusion, co-extrusion, lamination or coating processes. Various polymer materials suitable for use in a base substrate of a blister package are known to those skilled in the art, such materials providing for example structural integrity, or moisture and gas barrier properties; at least the product facing layer should be substantially inert to the product. Suitable polymers include polyester, polyacrylate, polycarbonate, polyolefin, polystyrene, polyvinyl chloride (PVC), including copolymers and blends thereof; preferred polymers include polyester, polyacrylate, polypropylene and polyethylene, including copolymers and blends thereof; and more preferably, polyethylene terephthalate (PET), high density polyethylene (HDPE), polymethyl methacrylate (PMMA), polyethylene methacrylate, and copolymers of PET (e.g., glycol modified PET (PET G)), including copolymers and blends thereof. Suitable barrier materials for a laminate or coating include polychlorotrifluroethylene (PCTFE) and polyvinylidene chloride (PVDC) materials.

Similarly, the lidding film 14 F (that forms the cover layer 14) may be formed (e.g., laminated, coextruded, or coated) from one or more layers of polymer materials that provide for example, structural integrity, and/or moisture and/or gas barrier protection; again at least the product facing layer is substantially inert to the product. The sealant layer 26 may be any polymeric material, for example, a heat seal material chosen from ethylene vinyl acetate (EVA) copolymer, ethyl methyl acrylate (EMA) copolymer, styrene block copolymers (SBC), polyurethane, styrene ethylene butadiene styrene (SEBS) copolymers, and ethylene acrylic acid (EAA) copolymers, and more preferably EVA or SEBS, including copolymers and blends thereof. The lidding film may include for example layers of paper, metal foil, and heat seal adhesive; preferably it may include layers of paper, polyester, metal foil and heat seal adhesive; and more preferably layers of paper, PET, metal foil and heat seal adhesive.

The thicknesses of the various layers will depend on the manufacturing conditions and on the intended product and use environment. For example, the thickness of the base substrate 12 may be in a range of 5 to 50 mils (thousandths of an inch), preferably 7 to 40 mils, and more preferably 6 to 25 mils. The thickness of the cover layer may be in a range of 2 to 10 mils, preferably 3 to 9 mils, and more preferably 4 to 7 mils.

The product may be any product for which packaging of product units in individual cavities, in a sealed environment, is desired. For example, the product may be a food product (such as cooked foods, salads, desserts), a cosmetic product (such as artificial nails) or industrial product (such as nuts or bolts), or a medical product (e.g., drug, such as a capsule-shaped or tablet-shaped product. An individual cavity may be designed to hold one or more product units.

The dimensions of the section 22, product cavity 16 and sealing area 23 will also vary with the size and volume of the product, the manufacturing conditions, product size and composition, and use environment. For example, a rectangular section 22 for holding a capsule (elongated) or tablet (round) may be in a range of 2 inches in length and 2 inches in width, with a cavity size 16 ranging from 1 inch in length and 1 inch in width, wherein the corner (triangular) tab 18 may comprise an area defined by three side edges, each edge being in a range of 8-15 mm (millimeters) in length.

The dimensions of the notched line 17, and the severed and unsevered portions thereof, will vary based on materials, areas and thicknesses of the various components. For example, for a base substrate of polyester of 1-11 mils thickness, the length of each of the severed portions 17S may be in a range from 1.5 to 4 mm in length, preferably 1.75 to 3.75 mm in length, and more preferably 2.5 to 3.5 mm in length. The unsevered portions 17U are preferably shorter in length (e.g., 0.8 to 2 mm in length). The notched line 17 preferably comprises 40 to 90% severed portions (as a ratio of total length of the severed portions to total length of the notched line), preferably 60 to 90%, and more preferably in a range of 70 to 85% severed portions.

These and other embodiments of the present invention will be apparent to the skilled person and are intended to be included within the scope of the claimed invention.

What is claimed is:

1. A multi-cavity blister package comprising:

a thermoformed plastic base substrate formed of a non-PVC polymer material, the base substrate having a plurality of individual thermoformed recessed product cavities wherein each product cavity is configured to retain a product therein and has an associated sealing surface area (SSA) surrounding the product cavity, the base substrate having, for each individual product cavity, an associated notched line including alternating severed and unsevered line portions, the severed line portions extending completely through the thickness of the base substrate while the unsevered line portions maintain at least some uncut (integral) thickness of the base substrate intact;

an integral peelable cover layer removably attached to the upper surface of the base substrate for sealing the plurality of individual product cavities, wherein each SSA is disposed and configured to be removably attached to a lower surface of the peelable cover layer so as to enclose the product in each sealed individual product cavity in a sealed environment, the attached cover layer and base substrate forming the multi-cavity blister package having a plurality of separable sections defined by section lines cut through a thickness direction of the cover layer and base substrate, each section including at least one individual product cavity and associated notched line wherein the associated notched line extends across a portion of the SSA of the individual product cavity, is spaced apart from the individual product cavity, and extends between two points on a perimeter of the section, the perimeter of the section being defined by one or more outer edges of the base substrate and the section lines, or by the surrounding section lines if the section does not border an outer edge of the base substrate, such that the associated notched line separates a corner or other edge portion of the section from a remaining portion of the section, and wherein the corner or other edge portion of each section, after separation of the section from the base substrate, is configured to be bent and broken off by a user at the at least one associated notched line to form a pull tab that includes the broken off portion of the base substrate and the integral cover layer sealed thereto, enabling a user grasping the pull tab to peel back and separate the integral cover layer from the SSA surrounding the individual product cavity of the section to open the sealed environment and enable release of the product from the individual product cavity.

2. The blister package of claim 1, wherein each individual product cavity is configured to receive one of a medical, health, food, cosmetic, and industrial product.

3. The blister package of claim 1, wherein each individual product cavity is shaped in the form of a tablet or capsule.

4. The blister package of claim 1, wherein the associated notched line is a straight line or a curved line, or includes a combination of straight and curved line portions.

5. The blister package of claim 1, wherein the associated notched line extends between two edges of the section perimeter to form a corner broken off portion.

6. The blister package of claim 1, wherein the associated notched line extends between two points on one edge of the section perimeter to form a broken off portion.

7. The blister package of claim 1, wherein one or more of the thermoformed base substrate, and the cover layer, are of multilayer construction.

8. The blister package of claim 1, wherein the thermoformed plastic base substrate comprises one or more of polyester, polyacrylate, polycarbonate, polyolefin, and polystyrene, including copolymers and blends thereof.

9. The blister package of claim 8, wherein the thermoformed plastic base substrate comprises one or more of polyethylene terephthalate (PET), high density polyethylene (HDPE), polymethyl methacrylate (PMMA), polyethylene methacrylate, and glycol modified PET (PET G), including copolymers and blends thereof.

10. The blister package of claim 1, wherein the cover layer includes a sealant for removable attachment to the sealing surface area of the base substrate.

11. The blister package of claim 10, wherein the sealant comprises a heat sealable material.

12. The blister package of claim 1, wherein the thickness of the base substrate is in a range of 6 to 25 mils.

13. The blister package of claim 1, wherein the associated notched line comprises in a range of 40 to 90% severed portions as a ratio of total length of the severed portions to total length of the associated notched line.

14. The blister package of claim 13, wherein the associated notched line comprises in a range of 60 to 90% severed portions as a ratio of total length of the severed portions to total length of the associated notched line.

15. The blister package of claim 14, wherein the associated notched line comprises in a range of 70 to 85% severed portions as a ratio of total length of the severed portions to total length of the associated notched line.

* * * * *